US008911333B2

(12) United States Patent
Hunt

(10) Patent No.: US 8,911,333 B2
(45) Date of Patent: Dec. 16, 2014

(54) JUMP ROPE DEVICE COMPRISING A REMOVABLY-CONNECTED CABLE

(71) Applicant: CrossRope, LLC, Jacksonville, FL (US)

(72) Inventor: David Hunt, Jacksonville, FL (US)

(73) Assignee: CrossRope, LLC, Jacksonville, FL (US)

( * ) Notice: Subject to any disclaimer, the term of this patent is extended or adjusted under 35 U.S.C. 154(b) by 133 days.

(21) Appl. No.: 13/687,035

(22) Filed: Nov. 28, 2012

(65) Prior Publication Data

US 2013/0165299 A1 Jun. 27, 2013

Related U.S. Application Data

(60) Provisional application No. 61/578,889, filed on Dec. 22, 2011.

(51) Int. Cl.
*A63B 21/00* (2006.01)
*A63B 5/20* (2006.01)

(52) U.S. Cl.
CPC ..... *A63B 5/20* (2013.01); *A63B 2210/50* (2013.01)
USPC ..... 482/81

(58) Field of Classification Search
USPC ..... 482/81, 82, 148, 124
See application file for complete search history.

(56) References Cited

U.S. PATENT DOCUMENTS

| | | | |
|---|---|---|---|
| 22,551 | A | 1/1859 | Duchamp |
| 67,101 | A | 7/1867 | Browne |
| 566,816 | A | 9/1896 | Taylor |
| 652,617 | A | 6/1900 | Hotz |
| 770,869 | A | 9/1904 | Eoe |
| 789,332 | A | 5/1905 | Newman |
| 1,436,703 | A | 11/1922 | Fisher |
| 1,538,844 | A | 3/1925 | Titus |
| 1,817,616 | A | 8/1931 | Aoit |
| 2,253,075 | A | 8/1941 | Johnson |
| 2,466,243 | A | 4/1949 | Johnson |
| 2,719,038 | A | 9/1955 | Massa |
| 2,723,121 | A | 11/1955 | Caitwrighi |
| 2,918,282 | A | 12/1959 | Waterval |
| 2,942,881 | A | 6/1960 | Recalma |
| 2,968,117 | A | 1/1961 | Trombly |
| 3,068,007 | A | 12/1962 | Satehell |
| 3,082,571 | A | 3/1963 | Lewis |
| 3,107,092 | A | 10/1963 | Morris |
| 3,118,666 | A | 1/1964 | Fitch |
| 3,219,342 | A | 11/1965 | Melchiona |
| 3,363,898 | A | 1/1968 | Crovello |
| 3,415,515 | A | 12/1968 | Otto |
| 3,419,270 | A | 12/1968 | Eppy |
| 3,475,023 | A | 10/1969 | Fauvelle |
| 3,488,051 | A | 1/1970 | Papistas-Scherer |
| 3,517,931 | A | 6/1970 | Kalish |
| 3,642,277 | A | 2/1972 | Gersten |

(Continued)

*Primary Examiner* — Jerome W Donnelly
(74) *Attorney, Agent, or Firm* — Andrew Rush; PCT Law Group, PLLC

(57) ABSTRACT

Jump rope devices which allow for the quick and easy interchanging of a cable of varying weight and length from handles configured to provide smooth rotation of such cables at both low and high speeds are disclosed. Devices in accordance with the disclosure may comprise a ball bearing assembly configured to facilitate 360-degree rotation of the cable. In an aspect, the handle of such jump rope devices is comprised of a ball bearing portion which enables both speed of rotational movement for a plurality of relatively lighter cables, and strength and durability for a plurality of relatively heavier cables. Handles may further comprise a snap hook assembly configured to facilitate rapid interchanging of cables.

16 Claims, 5 Drawing Sheets

(56) References Cited

U.S. PATENT DOCUMENTS

| | | | |
|---|---|---|---|
| 3,669,133 | A | 6/1972 | Hyman |
| 3,762,704 | A | 10/1973 | Gingras |
| 4,065,537 | A | 12/1977 | Miller |
| 4,079,932 | A | 3/1978 | Schuetz |
| 4,101,123 | A | 7/1978 | Anthony |
| 4,109,906 | A | 8/1978 | Wilson |
| 4,136,866 | A | 1/1979 | Bouvier |
| 4,139,966 | A | 2/1979 | Connell |
| 4,157,827 | A | 6/1979 | Winston |
| 4,158,457 | A | 6/1979 | Hydro |
| 4,177,985 | A | 12/1979 | Hlasnicek |
| 4,179,119 | A | 12/1979 | Wolf |
| 4,201,382 | A | 5/1980 | Wilson |
| 4,218,057 | A | 8/1980 | Wilson |
| 4,293,125 | A | 10/1981 | Hinds |
| 4,315,623 | A | 2/1982 | Granderson |
| 4,351,526 | A | 9/1982 | Schwartz |
| 4,375,886 | A | 3/1983 | Muys |
| 4,489,934 | A | 12/1984 | Miller |
| 4,505,474 | A | 3/1985 | Mattox |
| 4,563,002 | A | 1/1986 | Jardine |
| 4,593,903 | A | 6/1986 | Waitz |
| 4,618,142 | A | 10/1986 | Joseph, Jr. |
| 4,627,618 | A | 12/1986 | Schwartz |
| 4,637,606 | A | 1/1987 | Hunn |
| 4,647,037 | A | 3/1987 | Donohue |
| 4,682,774 | A | 7/1987 | Holy |
| 4,733,861 | A | 3/1988 | Plunkett, III |
| 4,736,945 | A | 4/1988 | Vinciguerra |
| 4,776,585 | A | 10/1988 | Maleyko |
| 4,778,173 | A | 10/1988 | Joutras |
| 4,784,391 | A | 11/1988 | Herron |
| 4,787,624 | A | 11/1988 | Grant |
| 4,801,137 | A | 1/1989 | Douglass |
| 4,892,063 | A | 1/1990 | Garrigan |
| 4,955,601 | A | 9/1990 | Ueng |
| 5,004,228 | A | 4/1991 | Powers |
| 5,022,646 | A | 6/1991 | Kessler |
| 5,054,772 | A | 10/1991 | Winston |
| 5,058,883 | A | 10/1991 | Dybvik |
| 5,167,599 | A | 12/1992 | Haller |
| 5,211,612 | A | 5/1993 | Carbonero |
| 5,215,509 | A | 6/1993 | Meyer |
| 5,234,393 | A | 8/1993 | Heinrich |
| 5,373,814 | A | 12/1994 | Seymour |
| 5,445,586 | A | 8/1995 | Yun |
| 5,478,297 | A | 12/1995 | Dennis, Jr. |
| 5,514,058 | A | 5/1996 | Buoni |
| 5,533,952 | A | 7/1996 | Schaber |
| 5,549,528 | A | 8/1996 | Bryant |
| 5,662,561 | A | 9/1997 | McNamara |
| 5,749,812 | A | 5/1998 | Feciura |
| 5,842,956 | A | 12/1998 | Strachan |
| 5,984,845 | A | 11/1999 | Powers |
| 6,193,637 | B1 | 2/2001 | Corbin |
| 6,196,921 | B1 | 3/2001 | Larson |
| 6,406,407 | B1 | 6/2002 | Wiedmann |
| 6,524,226 | B2 | 2/2003 | Kushner |
| 6,540,649 | B1 | 4/2003 | Niedrich |
| 6,544,148 | B1 | 4/2003 | Loew |
| 6,736,763 | B1 | 5/2004 | Hsu |
| 6,752,746 | B1 | 6/2004 | Winkler |
| 6,887,188 | B1 | 5/2005 | Davies |
| 7,086,951 | B2 | 8/2006 | Chang |
| 7,172,534 | B1 | 2/2007 | Joy |
| 7,896,783 | B2 | 3/2011 | Kessler |
| 7,981,502 | B2 | 7/2011 | Lammer |

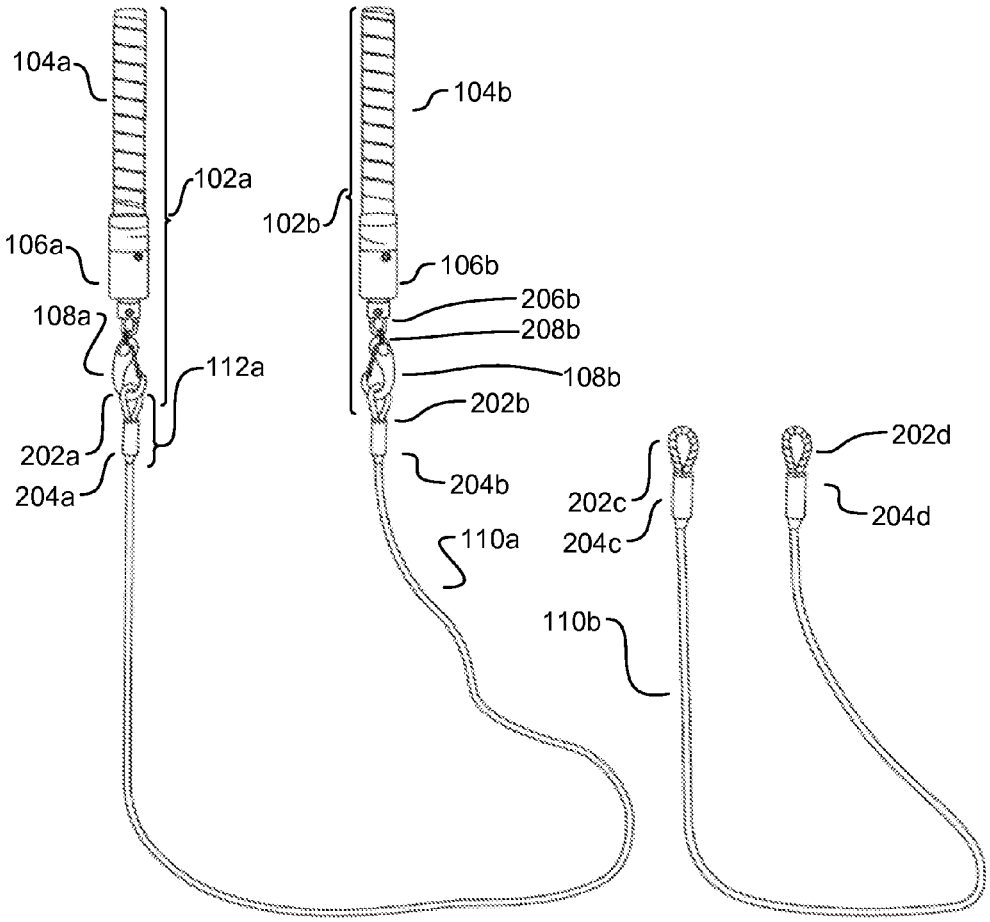
FIG. 2A
FIG. 2B
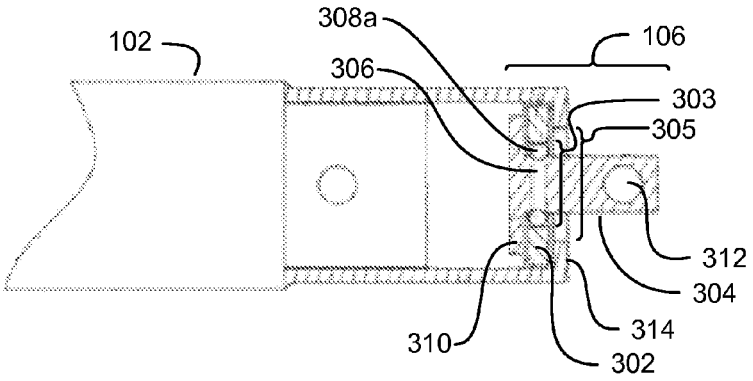
FIG. 3

JUMP ROPE DEVICE COMPRISING A REMOVABLY-CONNECTED CABLE

CROSS-REFERENCE TO RELATED APPLICATION

This application claims the benefit of U.S. Provisional Patent Application No. 61/578,889, filed Dec. 22, 2011, and entitled "Interchangeable Cable Jump Rope System," the entire contents of which are incorporated herein by reference.

FIELD OF THE DISCLOSURE

The present disclosure relates to exercise equipment and more particularly to jump rope devices.

BACKGROUND

Jumping rope has been a popular children's activity since the Middle Ages. Since the 1970's, it has come into the mainstream as a staple of many of the most popular exercise regimes. For example, jumping rope is an essential part of the CrossFit exercise program (available from CrossFit, Inc. of Washington, D.C.). More than 4,000 gyms offer CrossFit classes and hundreds of thousands of people a year follow the program.

Jumping rope has long been a popular exercise due to its health benefits in aerobic and anaerobic training, as well as the enjoyment in performing fun, challenging, and dynamic variety of skills. Jump rope routines may condition multiple muscle groups simultaneously via a natural, full-body motion.

Jump rope routines have a short learning curve because jumping rope leverages natural body motions. This gentle learning curve makes jumping rope accessible to easily discouraged novices, increasing the chances that a new jump roper will stick with a jump-rope-based workout regime. This may provide an opportunity to offer additional jump rope-based products to a jump rope user as they progress such as additional workout videos, new jump ropes and the like.

Jumping rope has become an increasingly popular cross-training exercise because of recent fitness trends that indicate a preference for exercises that offer functional, full-body motions that condition several muscles and train several skills in a natural body motion. Jump ropes are uniquely suited to cross-training exercise regimes because the user may vary the resistive forces of the jump rope in a variety of ways. For example, the centripetal force exerted by a jump rope as it is being rotated is proportional to the mass of the jump rope. Thus, if the mass of the jump rope is doubled, a jump roper must work about twice as hard to spin the rope at the same speed. The centripetal force exerted by a jump rope as it is being rotated is proportional to the square of the rope's angular velocity. Thus, if the jump rope spins twice as fast, a jump roper must work four times as hard to counteract the centripetal force exerted by the spinning jump rope.

This unique combination of resistive forces (i.e. centripetal force due to jump rope mass and configuration and centripetal force due to jump rope speed) enables anaerobic and aerobic exercise using the same equipment, during the same exercise routine. The availability of strength training and cardiovascular workouts from a single piece of exercise equipment greatly increases the utility of the equipment to the user. It reduces the equipment needed to successfully exercise. Additionally, user familiarity and comfort with the jump rope is increased because the user spends a significant amount of time with the jump rope instead of dividing time between multiple exercise apparatuses.

If a jump rope of appropriate size and weight is provided, jumping rope enables the user to target specific muscle groups and to develop fast twitch muscle or slow twitch muscle. For example, thin and light jump ropes enable the user to focus on cardiovascular fitness. This may tone the users muscles and reduce fat. Heavier ropes may be utilized by users wishing to improve muscle tone and bulk in their forearms, biceps, and shoulders.

Specialized workouts may be used in conjunction with specifically chosen jump ropes in order to target certain muscle groups during exercise. High knee jumping with a heavy jump rope, for example, may target the user's arms and core muscles. Single- and double-leg high knee exercises may greatly increase fast twitch leg muscles. Over time this may enable high power output in the user's legs. Side rope swings may isolate and improve the fitness of the user's arms when consistently added to a workout routine.

While a jump rope's resistance may be varied during a workout (thereby transitioning between anaerobic and aerobic exercise), and different jump rope-based workout routines may be used to target certain muscle groups, further enhancing the flexibility and utility of a jump rope is desirable. One method of providing enhancements is providing a jump rope with adjustable features such as adjustable or interchangeable physical characteristics.

There are several known examples of jump ropes that have adjustable features. However, the effectiveness, ease of adjustment, and scope of scalability of these adjustments has not been fully realized. Jump rope handles have been disclosed which are capable of simultaneously connecting multiple ropes. However, this design results in handles that are awkward to hold and make jumping rope more difficult because of the number of ropes that have to pass beneath a jumper's feet and that could get caught.

In order to improve the functionality of a jump rope, some jump ropes, such as those disclosed in U.S. Pat. No. 4,101,123 to Anthony, contain a ball bearing embedded in the handle that can be removed. However, this design limits the potential weight of the rope because excessive centrifugal force while jumping rope could unexpectedly dislodge the ball bearing from the rope.

The functionality of a jump rope may be expanded by altering the physical characteristics of the rope itself. For example, U.S. Pat. No. 4,109,906 to Wilson discloses a jump rope that allows interchanging of a stiff bottom center section of the rope in order to widen and flatten the base over which the jumper jumps in an effort decrease the necessary skill or ability required to perform the jump roping action. The interchanging center section allows the user to vary the resistance by selecting a section that varies in weight and stiffness. However, this is an ineffective method to vary resistance due to the awkward shape of the rope structure where one end of the center section can hit the ground before the other end does. This results in the rope bouncing up to hit the jumper's foot or leg. Additionally, this rope shape does not give the jumper the ability to perform any arm crossing or side-to-side rope jumping skills because the center section obstructs the performance of these types of motion.

U.S. Pat. No. 4,177,985 to Hlasnicek also discloses a jump rope with variable weight configurations. The handles have overlapping plastic sleeves that may remain on the handles for the lighter of the rope weight configurations or the user may slide the sleeves down to the center of the rope to overlap the existing plastic segments resulting in a slightly higher rope weight and resulting resistance. However, this design limits the variety and variability of weighted configurations and the composite jump rope weight does not change, just the positioning of the weight. Exclusion of a means to alter the mass of the jump rope limits the functionality and versatility of the jump rope.

Some jump rope devices disclose methods of adding mass to the jump rope, such as utilizing a hollow tube as the rope portion of the jump rope device and then filling the tube with a material such as sand or water. Although this provides a method of increasing the mass of the rope, such designs bend easily and in an unpredictable manner, resulting in an inconsistent and inefficient motions and thus, inefficient workouts.

Different motions are essential to a versatile jump rope exercise regime. For example, many jumping techniques target the upper body by incorporating arm- or hand-crossing movements. When a jump rope is used in such a manner, the design of the attachment point of the rope to the handle is critical. Many jump rope designs, such as U.S. Pat. No. 4,637,606 to Hunn, disclose a jump rope handle with a radial bearing and a plastic member with an exterior recess whereby the rope can be attached using a universal connector. The radial bearing orientation, however, is not optimal for any hand crossing jump rope motions.

Some jump rope devices disclose the addition of mass to the handles of the jump rope device. While the addition of mass to the handles of a jump rope device does have some effect on a workout routine, the addition of mass to the rotating portion of the jump rope device have a much greater impact on resistive forces imparted on the user during a workout. Additionally, increasing mass on the rotating portions (i.e. the rope portion) of a jump rope device allows the jump rope device to be more versatile because resistive forces can be varied by spinning the jump rope faster or slower.

Some jump rope devices, such as U.S. Pat. No. 6,544,148 to Loew, disclose a jump rope wherein the weight of the handles and the weight of the rope can be adjusted via the addition of counterweights at designated areas on the rope. This results in a lack of uniformity in the mass distribution of the rope. Such uneven mass distribution yields an awkward feel and operation, resulting in less efficient workouts and an increased learning curve for novice users.

Although jump ropes have existed for a long time in many various embodiments, there is an emerging niche market for a jump rope that has several customized characteristics in order to meet a jump rope user's specific workout needs. Some examples of this are very lightweight, fast revolving jump ropes used for speed and quickness exercises and skills. Other jump rope devices utilize heavy ropes for strength-type training. Quality jump ropes that meet these needs tend to be very expensive. For a jump rope user who wants to perform multiple types of jump rope exercises and workouts it can be expensive to purchase multiple jump ropes. An additional problem for consumers is that heavy jump ropes traditionally have been constructed of materials that are prone to breakage, particularly at the interface between the handle and the rope.

Currently, no jump rope device exists which can provide a fun, challenging, scalable training routine for novices, advanced users, and those in between. Thus, what is needed is a jump rope device which enables anaerobic and aerobic workouts for a variety of skill levels. Additionally, what is needed is a jump rope device which enables traditional jumping motions in addition to arm-crossing and hand-crossing motions.

Given the foregoing, strong, durable connection points that provide smooth and fast rotation for both heavy and light jump ropes are also needed. Additionally, there is a need for jump rope handles configured to easily attach and detach cables of varying characteristics including thickness, mass, and length.

SUMMARY

This Summary is provided to introduce a selection of concepts in a simplified form that are further described below in the Detailed Description. This Summary is not intended to identify key features or essential features of the subject matter to be claimed, nor is it intended to be used to limit the scope of the subject matter to be claimed.

Aspects of the present disclosure address the above-described needs by providing devices which allow for the quick and easy interchanging of a cable of varying weight and length from handles configured to provide smooth rotation of such cables at both low and high speeds.

Jump rope devices in accordance with the present disclosure provide a fun, challenging, scalable training routine for novices, advanced users, and those in between. Such devices enable anaerobic and aerobic workouts for a variety of skill levels. Additionally, such devices enable traditional jumping motions in addition to arm-crossing and hand-crossing motions. Such devices comprise handles configured to easily attach and detach cables of varying characteristics including thickness, mass, and length.

A variety of desirable exercise motions are enabled by jump rope devices in accordance with the present disclosure including: basic bounce step, the alternate foot step, criss cross, side rope swings, single- and double-leg high knee exercises, double unders, run skipping, and the "Ali shuffle." Because jump rope devices in accordance with the present disclosure enable a variety of workout exercises such as those listed above, such devices provide a versatile and efficient platform for anaerobic and aerobic exercise. Such devices enable workout for a wide range of skill levels, from novices to advanced users. Cables may be easily and quickly interchanged during a workout, thereby enabling a wide range of exercises and resistance levels during a single session. This reduces the need for multiple specialized pieces of exercise equipment. Such pieces of exercise equipment may be replaced by a single, portable jump rope device comprising two handles and one or more cables of varying physical characteristics.

Cables of varying sizes and weights may be used with jump rope devices in accordance with the present disclosure. Different-sized jump rope cables will provide different amounts of centrifugal resistance at equal rotational speeds. Utilization of varied cables strengthens a user's body through adaptation to varied stimuli of increased weight and/or resistance.

Lighter cables enable rapid rotation, speed-type workouts, targeting cardiovascular endurance. Jump rope devices equipped with lighter cables also have a lower learning curve, making such devices good for beginners. Heavier cables enable the user to focus on improving muscle strength and may be appropriate for targeting cardiovascular endurance in more advanced users, as well as improved upper body strength.

Aspects of the present disclosure are adapted for use with both lighter cables and heavier cables. The handle of such jump rope devices is comprised of a ball bearing portion which enables both speed of rotational movement for a plurality of relatively lighter cables and strength and durability for a plurality of relatively heavier cables. Handles may comprise a ball bearing and snap hook assembly which is configured to freely rotate 360 degrees and adapted to withstand rotational forces imparted by both light and heavy cables.

Aspects of the present disclosure allow a user to adjust the level of resistance in the device by utilizing ropes of differing masses and configurations.

Cables in accordance with the present disclosure may be configured for endurance training (e.g., a thin, 40 gram cable), for strength training (e.g., a 1.5 kilogram cable), or cross-training (e.g., a 500 gram cable). Cables may be configured for users of varying heights. For example, cables adapted for use by users under 1.5 meters may be 2.1 meters long. Cables adapted for use by users approximately 1.8 meters tall may be 2.9 meters long.

Cables may be made of a variety of materials including rope, leather, nylon, pro-vinyl, cloth, braided steel, and vinyl or polyvinyl chloride coated steel cable. In some aspects, end portions of the cables are configured to removably connect to the jump rope handles.

In an aspect, the end portions may be loop portions, configured to be removably connected to handle snap hook assemblies.

In an aspect, a jump rope device comprises two handles. The handles are configured to facilitate rotation of a cable during jump rope exercise. The handles each comprise a handle grip and a handle rotator. The handle rotator comprises a handle connector.

The handle grip comprises a inner portion, located closer to the sagittal plane of a user when the user is utilizing the jump rope device. The handle grips further comprise a outer portion, located farther away from the sagittal plane of a user when the user is utilizing the jump rope device. The outer portion of the handle grip may be rigidly connected to the handle rotator.

The handle rotator is configured to facilitate 360-degree rotation of portions of the jump rope device connected on the outer portion of the handle connector, such as the handle connector and a cable. The handle rotator may be a ball bearing assembly comprising a protruding joint pin. The joint pin may be configured to movably connect with the handle connector.

The handle connector is configured to interface between the handle rotator and the cable and allow a cable to be removably attached to the jump rope handle. In an aspect, the handle connector is a snap hook assembly.

In an aspect, jump rope handles may be comprised of wood, aluminum, polyvinyl chloride, or other substance and are securely attached to a housing that encases a ball bearing assembly with a protruding joint pin. The joint pin is attached to a spring gate snap hook by a split ring. The jump rope cable is a polyvinyl chloride coated galvanized steel cable. The cable is formed into loops and secured firmly in place by a swaged aluminum collar at each end. The loops are easily attached to the jump rope handles by inserting each loop into the opening of the spring gate snap hook which then closes on the loop for each handle and secures the cable to the jump rope handles. The attached cable is easily detached by depressing the spring gate portion of the spring gate snap hook and removing the loop portion in order to free the handles for the attachment of an alternate cable.

Further features and advantages of the devices and systems disclosed herein, as well as the structure and operation of various aspects of the present disclosure, are described in detail below with reference to the accompanying figures.

BRIEF DESCRIPTION OF THE DRAWINGS

The features and advantages of the present disclosure will become more apparent from the Detailed Description set forth below when taken in conjunction with the drawings in which like reference numbers indicate identical or functionally similar elements.

FIGS. 2A and 2B are schematic views of a jump rope device comprising two cables which may be removably connected to the handles, in accordance with various aspects of the present disclosure.

FIG. 3 is a cutaway view of a portion of a handle rotator, namely a joint pin and bearing assembly, in accordance with an aspect of the present disclosure.

DETAILED DESCRIPTION

The present disclosure is directed to jump rope devices which allow for the quick and easy interchanging of a cable of varying weight and length from handles configured to provide smooth rotation of such cables at both low and high speeds. Devices in accordance with the disclosure may comprise a ball bearing assembly configured to facilitate 360-degree rotation of the cable.

Jump rope devices in accordance with the present disclosure facilitate a variety of traditional as well as modern jump rope-based exercises. Such exercises include: basic bounce step, the alternate foot step, criss cross, side rope swings, single- and double-leg high knee exercises, double unders, run skipping, and the "Ali shuffle."

Figure 1:
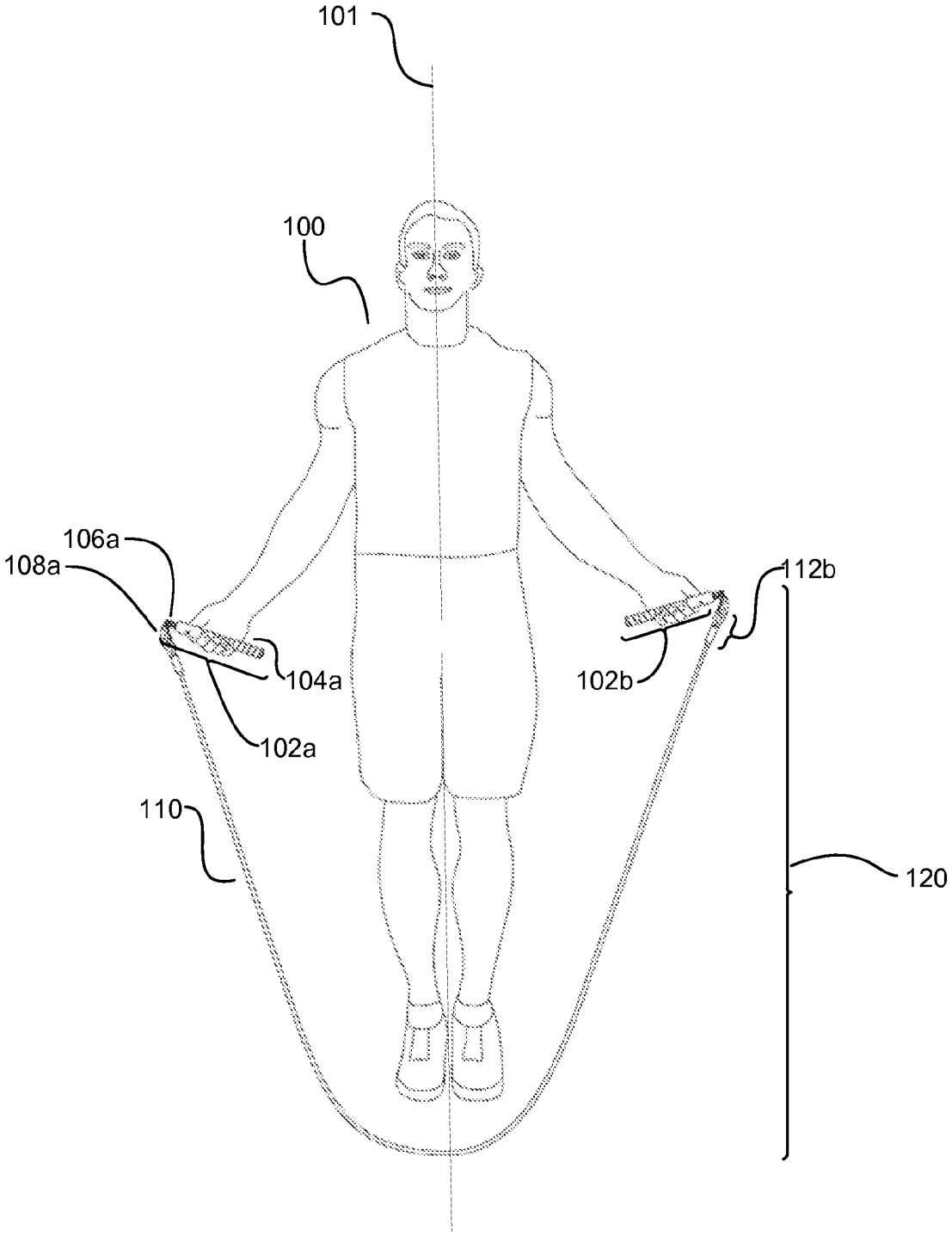
FIG. 1 is a front view of a jump rope device being utilized by a user, in accordance with an aspect of the present disclosure.

Referring to FIG. 1, a front view of a jump rope 120 being utilized by a user 100, in accordance with an aspect of the present disclosure, is shown.

Hereinafter, an "inner" portion of an element refers to a portion of an element which is closer to the sagittal plane 101 of user 100 when user 100 is utilizing jump rope 120 to perform a basic bounce step, as shown in FIG. 1. Hereinafter, an "outer" portion of an element refers to a portion of an element which is farther away from sagittal plane 101 of user 100 when user 100 is utilizing jump rope 120 to perform a basic bounce step.

Jump rope 120 comprises two handles 102 (i.e., a right handle 102*a* and a left handle 102*b*) and a cable 110. Cables of varying sizes and weights may be used with jump rope devices 120 in accordance with the present disclosure. Varying-sized cables 110 will provide different amounts of centrifugal resistance at equal rotational speeds. Utilization of varied cables 110 strengthens a user's body through adaption to varied stimuli of increased weight and/or resistance. In an aspect, cable 110 may be at least partially constructed from one or more of rope, leather, nylon, pro-vinyl, cloth, braided steel, vinyl coated steel cable and any other suitable material as will be apparent to those skilled in the relevant art(s) after reading the description herein.

Handles 102 are configured to facilitate user operation of jump rope 120. Handle may comprise handle grip 104 (shown, for clarity, only as handle grip 104*a* in FIG. 1) and handle rotator 106*a* (shown, for clarity, only as handle rotator 106*a* in FIG. 1). Handle 102 may be comprised of wood, steel, carbon fiber, aluminum, polyvinyl chloride, or any other materials as will be apparent to those skilled in the relevant art(s) after reading the description herein.

Handle grip 104 is configured to allow user 100 to hold jump rope 120 and manipulate cable 110. Handle grip 104 comprises an inner portion and an outer portion, the outer portion of the handle grip may be rigidly connected to handle rotator 106.

Handle rotator 106 is configured to removably connect cable 110 to handle 102. Handle rotator is further configured to facilitate 360-degree rotation of cable 110 relative to handle 102. Handle rotator 106 may be located on an outer portion of handle 102. In order to facilitate 360-degree rotation, handle rotator 106 may comprise a bearing, such as a plain bearing, a rolling-element bearing, an air bearing, a ball bearing, or a bushing.

Handle rotator 106 may further comprise a handle connector 108 (shown, for clarity, only as handle connector 108*a* in FIG. 1). Handle connector 106 is configured to removably connect handle 102 to cable 110. In an aspect, handle connector 108 comprises a snap hook assembly adapted to quickly and easily interchange cables 110 of varying weights and lengths from handles 102. Where handle connector 108 comprises a snap hook assembly, cable end portions 112 (shown, for clarity, only as loop 112*b* in FIG. 1) may comprise a loop configured to insertably and removably connect to the snap hook assembly, such that cable 110 may smoothly rotate during operation of jump rope 120.

In another aspect, handle connector 108 comprises an opening through which a portion of cable 110 may be removably connected for movement to handle 102. Such an opening may by an eyelet, a bore, an eyehook, or another portion adapted to removably connect to cable 110 as will be apparent to those skilled in the relevant art(s) after reading the description herein. In such an aspect, end portion 112 may comprise a snap hook assembly or other removable connection means. In another aspect, end portion 112 is inserted through the opening and tied securely to handle connector 108. In another aspect, end portion 112 is inserted through the opening and tied to another portion of cable 110. In yet another aspect, end portion 112 may be a D-ring, an O-ring, or a shackle and pin assembly.

In another aspect, handle connector 108 comprises a D-ring, an O-ring, or a shackle and pin assembly, adapted to removably connected to cable 110.

Referring now to FIGS. 2A and 2B, schematic views of jump rope 120 comprising two cables 110 which may be removably connected to handles 102, in accordance with various aspects of the present disclosure, are shown.

Handle 102 comprises handle grip 104. Handle rotator 106 is located at an outer portion of handle 104. Handle rotator comprises a bearing assembly and handle connector 108. In the aspect depicted in FIG. 2, handle connector 108 comprises a snap hook. The snap hook may be a spring gate snap hook comprising a moveable portion held in a close position by one or more spring elements. The snap hook assembly further comprises one or more chain links 206 (shown, for clarity, only as chain link 206*b* in FIG. 2A) and one or more split rings 208 (shown, for clarity, only as split ring 208*b* in FIG. 2A). Chain link 206 may be movably connected at an inner portion to the bearing assembly and movably connected at an outer portion to split ring 208. Split ring 208 may be movably connected at an inner portion to chain link 206 and moveably connected at an outer portion to snap hook 108. Snap hook 108 may be moveably connected at an inner portion to split ring 208 and moveably connected at an outer portion to cable end portion 112 (labeled, for clarity, only as end portion 112*a* in FIG. 2A).

In another aspect, the snap hook assembly may comprise one or more split rings 208, movably connected at an inner portion to the bearing assembly and moveably connected at an outer portion to snap hook 108.

End portion 112 may comprise a loop 202, secured by a collar 204. Collar 204 temporarily or permanently secures the portion of cable 110 which forms loop 202.

In another aspect, end portion 112 may be a stamped eyelet. In such an aspect, end portion 112 may be formed from the same material as cable 110 (e.g., vinyl coated steel cable).

Jump rope 120 may be comprised of one or more cables 110 (shown, for clarity as cable 110*a* in FIG. 2A and cable 110*b* in FIG. 2B). Such cables 110 may be interchanged, providing different exercise experiences and challenges. Cable 110*b*, shown in FIG. 2B, may weigh, for example, 1.5 kilograms, providing a muscle building-oriented exercise experience. Cable 110*a*, shown in FIG. 2A, may weigh, for example, 40 grams, providing an endurance building-oriented exercise experience.

Referring now to FIG. 3, a cutaway view of a portion of handle 102, namely a joint pin 304 and bearing 302 assembly, in accordance with an aspect of the present disclosure, is shown.

Outer portion of handle 102 comprises handle rotator 106. Handle rotator may comprise bearing 302. Bearing 302 may a ball bearing configured to facilitate 360-degree rotation. Bearing is configured to retain a plurality of balls 308 (shown, for clarity, only as ball 308*a* in FIG. 3). In an aspect, bearing 302 comprises an inner bearing portion, an outer bearing portion and a bearing inner bore 303, configured to retain a plurality of balls 308.

Handle rotator further comprises joint pin 304. Joint pin 304 is configured to rotate freely within bearing 302 and to withstand forces imparted upon handle 102 by cable 110 during jump rope operation. A portion of joint pin 304 protrudes from bearing 302, providing a location for movably connecting cable 110. Outer portion of joint pin 304 may moveably connect to cable 110. In an aspect joint pin 304 further comprises joint pin opening 312, configured to moveably connect joint pin 304 to cable 110.

Joint pin 304 may comprise a flange 310 located at an inner portion of joint pin 304. Flange 310 is configured to retain joint pin 304 within handle 102. In an aspect, flange 310 is disc-shaped. In another aspect, flange 310 is rectangular, or some other shape having an area that is of sufficient size to retain joint pin 304 within handle 102.

Joint pin 304 may further comprise an annular groove 306. The annular groove may be located within the inner bore 303 of bearing 302 such that the plurality of balls may be partially placed within annular groove 306 and engage joint pin 304 and bearing 302, facilitating free rotation of joint pin 304.

The outer portion of handle 102 may further comprise a retainer 314. Retainer 314 is a physical stop configured to physically engage with bearing 302 and prevent the separation of bearing 302 from handle 102. In an aspect, retainer 314 inner portion is permanently attached to bearing 302 outer portion, preventing rotation of bearing 302 relative to handle 102 and separation of bearing 302 from handle 102.

Retainer 314 further comprises a retainer inner bore 305. In an aspect, the inner portion of retainer 314 prevents movement of bearing 302 in an outer direction and the cross section of the retainer inner bore 305 is greater than the cross section of the bearing inner bore 303.

Figure 4A:
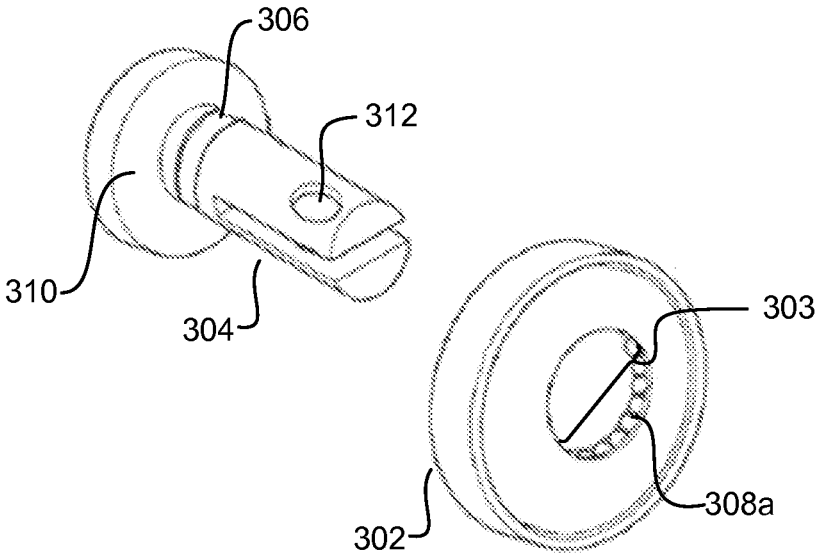
FIGS. 4A and 4B are perspective views of a joint pin and bearing assembly, in accordance with an aspect of the present disclosure.
Figure 4B:
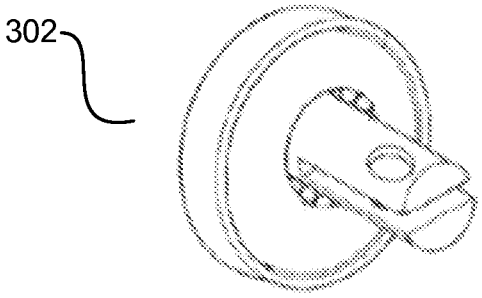

Referring briefly now to FIGS. 4A and 4B, perspective views of joint pin 304 and bearing 302 assembly, in accordance with an aspect of the present disclosure, are shown.

FIG. 4A depicts bearing 302 and joint pin 304 in a separated configuration. Bearing 302 comprises an inner bore 303 and a plurality of tightly packed balls 308 (shown, for clarity, only as ball 308*a* in FIG. 4A). FIG. 4B depicts bearing 302 and joint pin 304 in an engaged configuration. Joint pin 304 protrudes from bearing 302 by a distance chosen to facilitate movable connection with cable 110 and 360-degree rotation of cable relative to handle 102.

Figure 5:
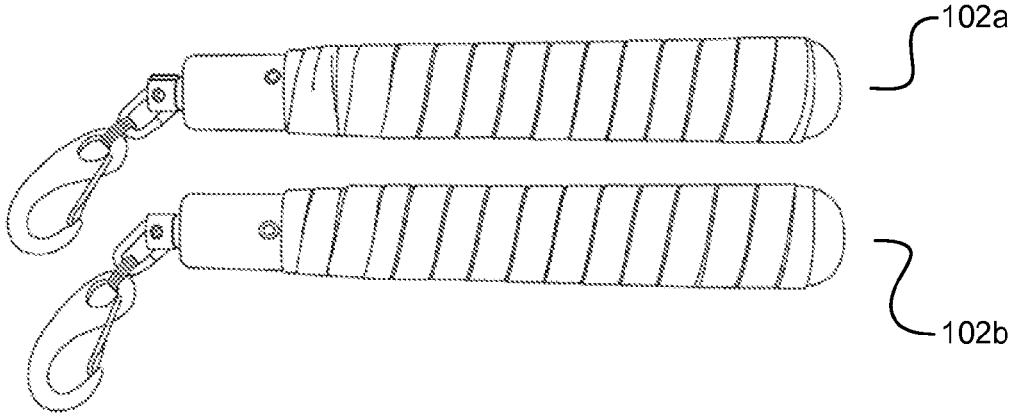
FIG. 5 is a side view of handles, in accordance with an aspect of the present disclosure.

Referring now to FIG. 5, a side view of handles 102, in accordance with an aspect of the present disclosure, is shown.

Handle grip 104 may be configured in a variety of manners in order to suit user 100. In an aspect, jump rope 120 may be configured for use by users with larger hands or in order to provide additional leverage when a heavy cable 110 is used. In such an aspect, handle grip 104 has a larger diameter and comprises grip tape.

Figure 6:
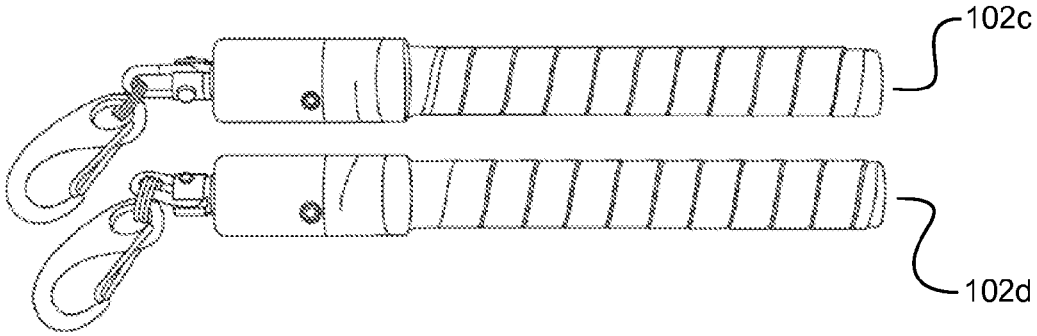
FIG. 6 is side view of handles in another configuration, in accordance with an aspect of the present disclosure.

Referring now to FIG. 6, a side view of handles 102, in accordance with another aspect of the present disclosure, is shown.

Jump rope 120 may be configured for use by users with smaller hands or in order to reduce mass. Reduction of handle mass may be preferred when using light cables 110 during cardiovascular fitness-oriented exercise. In such an aspect, handle grip 104 has a narrow, constant diameter and may optionally comprise grip tape.

Figure 7:
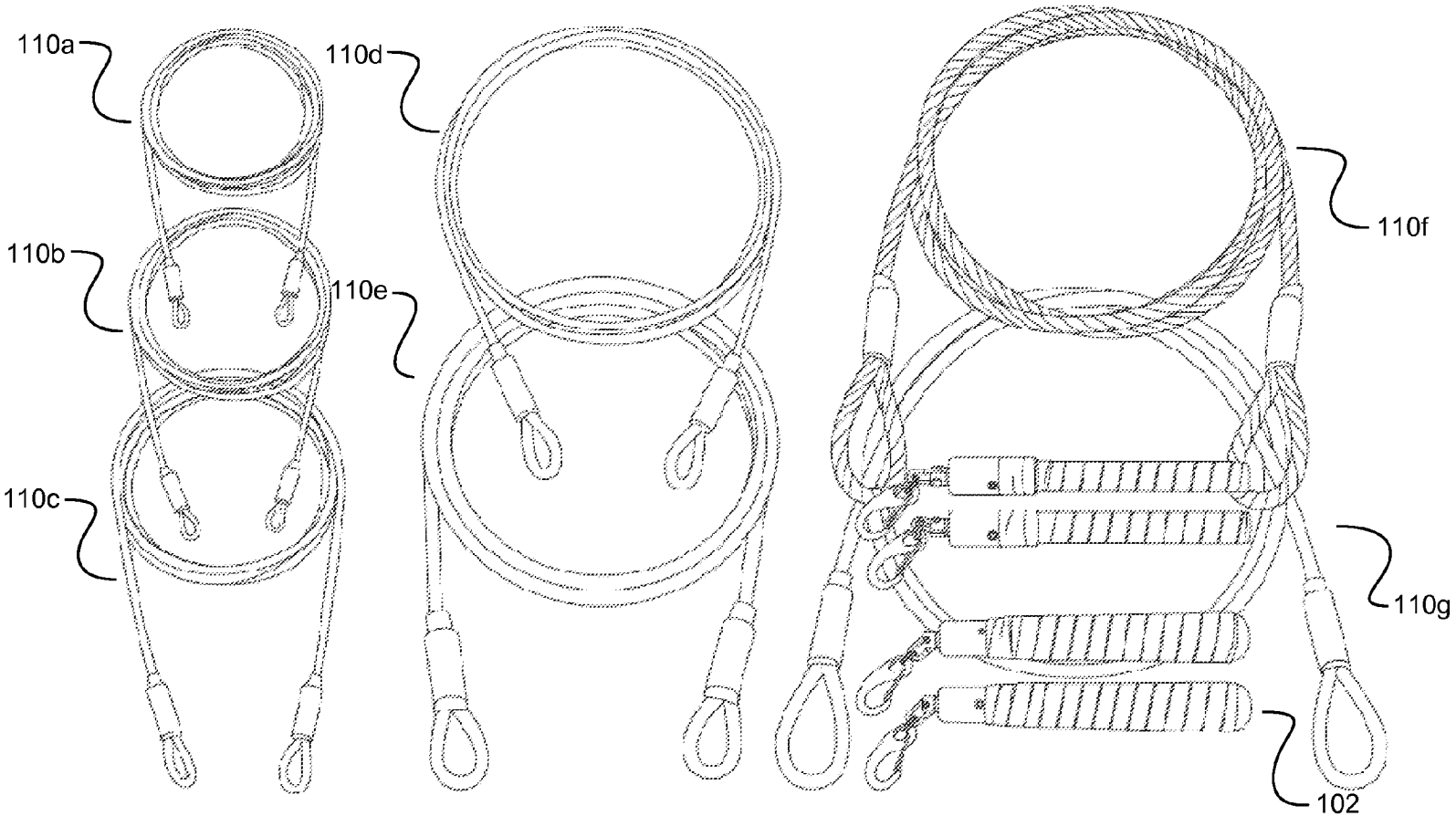
FIG. 7 is a front view of a plurality of handles and cables which may comprise a jump rope device, in accordance various aspects of the present disclosure.

Referring now to FIG. 7, a front view of a plurality of handles 102 and cables 110 which may comprise jump rope 120, in accordance with various aspects of the present disclosure, are shown.

Lighter cables (e.g., cables 110*a-c*) enable rapid rotation, speed-type workouts, targeting cardiovascular endurance. Jump ropes 120 equipped with lighter cables 110 also have a lower learning curve, making such devices good for beginners. Heavier cables (e.g., cables 110*d-g*) enable the user to focus on improving muscle strength and may be appropriate for targeting cardiovascular endurance in more advanced users.

Aspects of the present disclosure are adapted for use with both lighter and heavier cables 110. Handles 102 may be used with a variety of cables 110, including cables 110 configured for endurance training (e.g., a thin, 40 gram cable), for strength training (e.g., a 1.5 kilogram cable), or cross-training (e.g., a 500 gram cable). Cables 110 may be configured for users 100 of varying heights. For example, cables 110 adapted for use by users 100 under 1.5 meters may be 2.1 meters long. Cables 110 adapted for use by users 100 approximately 1.8 meters tall may be 2.9 meters long.

While various aspects of the present disclosure have been described above, it should be understood that they have been presented by way of example and not limitation. It will be apparent to persons skilled in the relevant art(s) that various changes in form and detail can be made without departing from the spirit and scope of the present disclosure. The present disclosure should not be limited by any of the above described aspects, but should be defined only in accordance with the following claims and their equivalents.

In addition, it should be understood that the figures, which highlight the structure, methodology, functionality and advantages of the present disclosure, are presented as examples only. The present disclosure is sufficiently flexible and configurable, such that it may be implemented in ways other than that shown in the accompanying figures.

Further, the purpose of the foregoing Abstract is to enable the U.S. Patent and Trademark Office and the public generally and especially the scientists, engineers and practitioners in the relevant art(s) who are not familiar with patent or legal terms or phraseology, to determine quickly from a cursory inspection the nature and essence of this technical disclosure. The Abstract is not intended to be limiting as to the scope of the present invention in any way.

What is claimed is:

1. A jump rope device, comprising:
- a plurality of handles, each handle comprising:
  - a handle grip, comprising:
    - an inner grip portion; and
    - an outer grip portion;
  - a handle rotator connected to the outer grip portion, the handle rotator comprising:
    - a bearing, comprising:
      - an inner bearing portion;
      - an outer bearing portion;
      - a bearing inner bore;
      - a plurality of balls; and
      - a joint pin, the joint pin rotatably connected to the bearing, the joint pin comprising:
        - an outer joint pin portion;
        - an annular groove; and
        - a joint pin flange; and
    - a handle connector, comprising:
      - an inner handle connector portion; and
      - an outer handle connector portion;
- wherein the handle connector is configured to removably connect a cable;
- wherein the outer joint pin portion protrudes through the bearing inner bore, the plurality of balls are partially located in the annular groove, the annular groove is located between the outer joint pin portion and the joint pin flange, and the joint pin flange engages the inner bearing portion;
- wherein the outer joint pin portion of the handle is moveably connected to the handle connector;
- wherein the bearing facilitates three-hundred and sixty degree rotation of the handle connector relative to the handle grip.

2. The jump rope device of claim 1, wherein the jump rope device comprises two handles.

3. The jump rope device of claim 2, wherein the two handles are each configured to enable jump rope exercise with a 1.5 kilogram cable.

4. The jump rope device of claim 1, wherein the joint pin flange is circular.

5. The jump rope device of claim 1, wherein the joint pin flange has a cross sectional length greater than the inner diameter of the bearing inner bore.

6. The jump rope device of claim 1, wherein the outer grip portion further comprises a retainer, comprising:
- an inner retainer portion;
- an outer retainer portion; and
- a retainer inner bore;
- wherein the inner retainer portion engages the outer bearing portion, the inner retainer portion prevents movement of the bearing in an outward direction, the outer joint pin portion protrudes through the retainer inner bore, and the cross section of the retainer inner bore is greater than the cross section of the bearing inner bore.

7. The jump rope device of claim 6, wherein the retainer is constructed of metal and configured to enable jump rope exercise with a 1.5 kilogram cable.

8. The jump rope device of claim 1, wherein the handle connector is one of: a D-ring, an O-ring, a snap hook, and a shackle.

9. The jump rope device of claim 1, wherein the handle is configured for use with cables weighing between 40 grams and 1.5 kilograms.

10. The jump rope device of claim 1, the jump rope further comprising:

a cable configured to enable jump rope exercise, the cable comprising:

a first cable portion;

a cable body; and a second cable portion;

wherein the first cable portion is configured to removably connect to one of the plurality of handles at the outer handle connector portion;

wherein the second cable portion is configured to removably connect to one of the plurality of handles at the outer handle connector portion;

wherein the cable is configured for three-hundred and sixty degree rotation; and wherein the length of the cable is chosen to facilitate jump rope exercise.

11. The jump rope device of claim 10, wherein the first cable portion and the second cable portion are each configured as a loop.

12. The jump rope device of claim 10, wherein the first cable portion and the second cable portion are each configured as an eyelet.

13. The jump rope device of claim 10, wherein the first cable portion and the second cable portion are each one of: a D-ring, an O-ring, a snap hook, and a shackle.

14. The jump rope device of claim 10, wherein the cable has a length of between 2.1 and 2.9 meters.

15. The jump rope device of claim 10, wherein the cable has a mass of between 40 grams and 1.5 kilograms.

16. A jump rope device, comprising:

a plurality of handles, each handle comprising:

a handle grip, comprising:

an inner grip portion; and an outer grip portion;

a handle rotator connected to the handle grip at the outer grip portion, the handle rotator comprising:

a bearing, comprising:

an inner bearing portion;

an outer bearing portion;

a bearing inner bore;

a plurality of balls; and a joint pin, the joint pin rotatably connected to the bearing, the joint pin comprising:

an outer joint pin portion;

an annular groove; and a joint pin flange; and a handle connector, comprising:

an inner handle connector portion; and an outer handle connector portion; and a cable configured to enable jump rope exercise, the cable comprising:

a first cable portion;

a cable body; and a second cable portion;

wherein the outer joint pin portion protrudes through the bearing inner bore, the plurality of balls are partially located in the annular groove, the annular groove is located between the outer joint pin portion and the joint pin flange, and the joint pin flange engages the inner bearing portion;

wherein the outer joint pin portion of the handle is moveably connected to the handle connector;

wherein the bearing facilitates three-hundred and sixty degree rotation of the handle connector relative to the handle grip;

wherein the first cable portion is configured to removably connect to one of the plurality of handles at the outer handle connector portion;

wherein the second cable portion is configured to removably connect to one of the plurality of handles at the outer handle connector portion;

wherein the cable is configured for three-hundred and sixty degree rotation; and wherein the length of the cable is chosen to facilitate jump rope exercise.

* * * * *